US010088156B2

(12) United States Patent
Leung et al.

(10) Patent No.: US 10,088,156 B2
(45) Date of Patent: Oct. 2, 2018

(54) WATER HEATER VENTING ASSEMBLY

(71) Applicants: Martin Kwan Yu Leung, Oakville (CA); Ivan Lee Stiehl, Burlington (CA)

(72) Inventors: Martin Kwan Yu Leung, Oakville (CA); Ivan Lee Stiehl, Burlington (CA)

( * ) Notice: Subject to any disclaimer, the term of this patent is extended or adjusted under 35 U.S.C. 154(b) by 0 days.

(21) Appl. No.: 15/612,616

(22) Filed: Jun. 2, 2017

(65) Prior Publication Data

US 2017/0356646 A1 Dec. 14, 2017

(30) Foreign Application Priority Data

Jun. 10, 2016 (CA) ..... 2932993

(51) Int. Cl.
*F23J 13/04* (2006.01)
*F24H 1/20* (2006.01)
*F23J 11/00* (2006.01)

(52) U.S. Cl.
CPC ..... *F23J 13/04* (2013.01); *F23J 11/00* (2013.01); *F24H 1/205* (2013.01)

(58) Field of Classification Search
CPC . F24F 11/0001; F02G 5/02; F23J 13/04; F23J 11/00; F24H 1/205
See application file for complete search history.

(56) References Cited

U.S. PATENT DOCUMENTS 1,408,375 A 2/1922 Manelis
4,940,042 A * 7/1990 Moore, Jr. ..... F23L 17/04 122/18.2
6,767,001 B2 7/2004 Anderson
7,074,121 B2 * 7/2006 Zhou ..... F23L 17/14 454/8
8,628,305 B2 1/2014 Leu et al.
8,851,022 B2 10/2014 Jacques et al.
8,881,688 B2 * 11/2014 English ..... F24H 9/0031 122/18.31
9,068,767 B2 * 6/2015 Lesage ..... F25B 25/005
9,506,662 B2 * 11/2016 Cimberio ..... F16K 5/0605
2014/0137851 A1 * 5/2014 Branecky ..... F24D 12/02 126/80
2017/0363323 A1 * 12/2017 Post ..... F23L 5/02
2017/0363324 A1 * 12/2017 Post ..... F24H 9/0031

FOREIGN PATENT DOCUMENTS

JP H01-305218 8/1989

* cited by examiner

*Primary Examiner* — Gregory A Wilson

(57) ABSTRACT

In a preferred embodiment, there is provided a water heater venting assembly for directing a combustion air and a flue gas between an outdoor atmosphere and a water heater, and which includes a generally hollow housing defining a combustion air aperture, a flue gas exhaust conduit disposed in the housing, and an adjustable inlet duct coupling assembly having a retention member for placement in the housing proximal to the aperture, a gasket for placement around an outer periphery of the aperture and a combustion air supply member. The retention member is for retaining the supply member in fluid sealing engagement with the gasket to effect fluid communication between the aperture and the supply member, and is sized to permit slidable movement of the supply member relative to the gasket.

26 Claims, 11 Drawing Sheets

WATER HEATER VENTING ASSEMBLY

SCOPE OF THE INVENTION

The present invention relates to a water heater venting assembly for directing a flue gas and a combustion air between a water heater and an outdoor atmosphere, and which preferably includes a housing and an adjustable duct coupling assembly to permit fluidic coupling between a coaxial gas pipe, and water heater inlet and outlet ducts of varying distances between the ducts.

BACKGROUND OF THE INVENTION

In various parts of the world, a typical residential building receives potable water through a single water supply line connected to a water main forming part of a local distribution system. To generate hot water from the potable water for various domestic uses including showers and baths, a water heater may be utilized to heat the potable water above its initial temperature as received from the water main.

Commercially available water heaters generally rely on thermal energy obtained from combustion of fossil fuels such as natural gas to heat water, and are normally intended for installation indoors, such as in the basement of a home. Similar to other machines and devices designed to perform fossil fuel combustion, for operation a water heater requires, in addition to a source of fossil fuels, a continuous supply of combustion air containing a level of oxygen required for the combustion, and creates a stream of flue gas having an elevated level of carbon dioxide as generated from the combustion. To ensure that operation of a water heater indoors does not deplete oxygen levels and elevate carbon dioxide levels beyond those acceptable for human inhabitation, a water heater is typically supplied with a duct work for communicating the generated flue gas to outdoors, and supplying a combustion air from outdoors to the water heater.

A water heater usually includes a cylindrical body having a tank for storage of water to be heated, a cold water inlet, a hot water outlet, an apparatus for applying heat to the stored water including a natural gas inlet, control valves and associated thermostat mechanisms, and a combustion chamber in which the natural gas is burned, and which is adapted to conduct or convey the heat of combustion to the stored water. A water heater may further include an upper body portion provided with a combustion air inlet duct for receiving a combustion air, as well as a flue gas outlet duct for expelling a flue gas generated inside the water heater, and which is spaced from the inlet duct. It is the function of a duct work to establish fluid communication between the inlet and outlet ducts and an outdoor atmosphere.

The applicant has appreciated that absent industry standard dimensions and placement of the outlet/inlet ducts on different water heaters manufactured by different companies, installation of the duct work may require custom fabrications and modifications for each different water heaters. In particular, with duct works provided a pair of conduits for connecting to the respective outlet/inlet ducts, a single coaxial double wall pipes for traversing a wall of a residential building and a gas joint for fluidically coupling the conduits and the coaxial pipe, modifications may be required to be introduced various physical changes to the conduits, joint and/or coaxial pipe, thereby increasing associated installation time and costs.

SUMMARY OF THE INVENTION

It is a non-limiting object of the present invention to provide a water heater venting assembly which may overcome the shortcomings associated with existing duct works or water heater venting assemblies, and which may permit for adjustments to operate with different water heaters of varying inlet/outlet duct dimensions and locations.

It is a further non-limiting object of the present invention to provide a water heater venting assembly which may operate to direct a combustion air and a flue gas between a water heater and an outdoor atmosphere, and which may permit for reduction in installation time and costs.

It is a further non-limiting object of the present invention to provide a water heater venting assembly which may permit for monitoring of a flue gas being generated from a water heater without necessarily requiring disassembly.

In one simplified aspect, the present invention provides a water heater venting assembly for directing a combustion air and a flue gas between an outdoor atmosphere and a water heater having a flue gas outlet duct and a combustion air inlet duct located at a lateral distance from the outlet duct, and which includes a generally hollow housing defining a combustion air aperture, a flue gas exhaust conduit at least partially disposed in the housing, and an adjustable inlet duct coupling assembly movably coupled to the housing, wherein the exhaust conduit is for fluid communication with the outlet duct, and the coupling assembly comprises a retention member for placement in the housing proximal to an inner periphery of the combustion air aperture, a resiliently deformable gasket for placement around an outer periphery of the combustion air aperture and a combustion air supply member having first and second axially open ends, the first axially open end being for fluid communication with the inlet duct, wherein in an assembled arrangement, the retention member is for retaining the supply member with the second axially open end in fluid sealing engagement with the gasket, thereby effecting fluid communication between the combustion air aperture and the supply member, and the retention member is sized to permit slidable movement of the supply member relative to the gasket to thereby allow the fluid communication between the first axially open end and the inlet duct at the lateral distance from the outlet duct.

In another aspect, the present invention provides a water heater venting assembly for directing a flue gas and a combustion air between a water heater and an outdoor atmosphere, the water heater having an upper heater portion, a flue gas outlet duct and a combustion air inlet duct, wherein each said duct extends generally upwardly from the upper heater portion at a lateral distance from the other duct, and wherein the venting assembly comprises a generally hollow housing, a flue gas exhaust conduit at least partially disposed in the housing, and an adjustable inlet duct coupling assembly movably coupled to the housing, wherein: the flue gas exhaust conduit comprises a generally vertically oriented lower conduit portion and an upper conduit portion in fluid communication with the lower conduit portion, the lower conduit portion being sized for fitted engagement with the flue gas outlet duct in fluid communication therewith to effect directing of the flue gas from the water heater towards the upper conduit portion; the housing comprises a body portion defining a downwardly open combustion air aperture, a downwardly open flue gas aperture, a laterally or upwardly open fluid exchange aperture and a generally hollow interior in fluid communication with each said aperture, the flue gas aperture being sized to receive the lower conduit portion therethrough in an assembled arrangement, whereby the exhaust conduit is at least partially disposed in the hollow interior with the upper conduit portion positioned proximal to the fluid exchange aperture; and the coupling assembly comprises a retention member, a resiliently deformable gasket for placement on the body portion around an outer periphery of the combustion air aperture, and an axially open tubular member comprising an upper tubular portion and a lower tubular portion in fluid communication with the upper tubular portion, the lower tubular portion being sized for fitted engagement with the combustion air inlet duct in fluid communication therewith, wherein in the assembled arrangement, the retention member is for placement in the hollow interior in at least partial abutting contact with an inner periphery of the combustion air aperture to movably hold the upper tubular portion in seated fluid sealing engagement against bias of the gasket around the outer periphery, thereby fluidically coupling the tubular member and the combustion air aperture, and wherein the retention member is sized to permit slidable movement of the upper tubular portion relative to the gasket about the combustion air aperture to thereby allow the engagement between the lower tubular portion and the inlet duct at the lateral distance from the outlet duct; and wherein the fluid exchange aperture is sized to fluidically couple to a combustion air supply pipe extending towards the outdoor atmosphere, and the upper conduit portion is sized to fluidically couple to a flue gas venting pipe disposed in the supply pipe.

In yet another aspect, the present invention provides a water heater venting assembly for directing a flue gas and a combustion air between a water heater and an outdoor atmosphere, the water heater having an upper heater portion, a flue gas outlet duct and a combustion air inlet duct, wherein each said duct extends generally upwardly from the upper heater portion at a lateral distance from the other duct, and wherein the venting assembly comprises a generally hollow housing, a flue gas exhaust conduit at least partially disposed in the housing, and an adjustable inlet duct coupling assembly movably coupled to the housing, wherein: the flue gas exhaust conduit comprises a generally vertically oriented lower conduit portion and an upper conduit portion in fluid communication with the lower conduit portion, the lower conduit portion being shaped for fluid communication with the flue gas outlet duct to effect directing of the flue gas from the water heater towards the upper conduit portion; the housing comprises a body portion defining a downwardly open combustion air aperture, a downwardly open flue gas aperture, a laterally open fluid exchange aperture and a generally hollow interior in fluid communication with each said aperture, the flue gas aperture being sized to receive the lower conduit portion therethrough in an assembled arrangement, whereby the exhaust conduit is at least partially disposed in the hollow interior with the upper conduit portion positioned proximal to the fluid exchange aperture; and the coupling assembly comprises a retention member, a resiliently deformable gasket for placement on the body portion around an outer periphery of the combustion air aperture, and an axially open tubular member comprising an upper tubular portion and a lower tubular portion in fluid communication with the upper tubular portion, the lower tubular portion being shaped for fluid communication with the combustion air inlet duct, wherein the retention member comprises an outer rim, a receiver ring, and two or more first support spokes each extending inwardly from the outer rim to the receiver ring, and wherein the upper tubular portion comprises an inner elongated cylindrical member sized to be removably received in the receiver ring and two or more second support spokes each extending inwardly from an inner surface of the upper tubular portion to the elongated cylindrical member; wherein in the assembled arrangement, the retention member is for placement in the hollow interior with the outer rim in at least partial abutting contact with an inner periphery of the combustion air aperture and the elongated cylindrical member removably received in the receiver ring, thereby movably holding the upper tubular portion in seated fluid sealing engagement against bias of the gasket around the outer periphery to fluidically couple the tubular member and the combustion air aperture, and wherein the outer rim is sized to permit slidable movement of the upper tubular portion relative to the gasket about the combustion air aperture to thereby allow the fluid communication between the lower tubular portion and the inlet duct at the lateral distance from the outlet duct, and wherein the fluid exchange aperture is sized to fluidically couple to a combustion air supply pipe extending towards the outdoor atmosphere, and the upper conduit portion is sized to fluidically couple to a flue gas venting pipe disposed in the supply pipe.

In yet another aspect, the present invention provides a fluid joint assembly for fluidically coupling a first fluid duct and a second fluid duct to a coaxial fluid pipe assembly having a first fluid pipe and a second fluid pipe disposed in the first fluid pipe in a generally coaxial orientation therewith, the fluid joint assembly being configured to fluidically couple the first fluid duct to the first fluid pipe, and the second fluid duct to the second fluid pipe, wherein the first fluid duct is located at a lateral distance from the second fluid duct, and wherein the fluid joint assembly comprises a generally hollow housing, a connecting conduit at least partially disposed in the housing, and an adjustable duct coupling assembly movably coupled to the housing, wherein: the connecting conduit comprises a first conduit portion and a second conduit portion in fluid communication with the first conduit portion, the second conduit portion being shaped for fluid communication with the second fluid duct; the housing comprises a body portion defining a first duct coupling aperture, a second duct coupling aperture lateral spaced from the first duct coupling aperture, a coaxial pipe coupling aperture and a generally hollow interior in fluid communication with each said aperture, the second duct coupling aperture being sized to receive the second conduit portion therethrough in an assembled arrangement, whereby the connecting conduit is at least partially disposed in the hollow interior with the first conduit portion positioned proximal to the coaxial pipe coupling aperture; and the coupling assembly comprises a retention member, a resiliently deformable gasket for placement on the body portion around an outer periphery of the first duct coupling aperture, and an axially open tubular member comprising a first tubular portion and a second tubular portion in fluid communication with the first tubular portion, the first tubular portion being shaped for fluid communication with the first fluid duct, wherein in the assembled arrangement, the retention member is for placement in the hollow interior in at least partial abutting contact with an inner periphery of the first duct coupling aperture to movably hold the second tubular portion in seated fluid sealing engagement against bias of the gasket around the outer periphery, thereby fluidically coupling the tubular member and the first duct coupling aperture, and wherein the retention member is sized to permit slidable movement of the second tubular portion relative to the gasket about the first duct coupling aperture to thereby allow the fluid communication between the first tubular portion and the first fluid duct at the lateral distance from the second fluid duct; and wherein the coaxial pipe coupling aperture is sized to fluidically couple to the first fluid pipe, and the first conduit portion is sized to fluidically couple to the second fluid pipe.

In one embodiment, the body portion comprises an upper wall, a lower wall defining the combustion air aperture and the flue gas aperture, and a sidewall having opposed forward and rear sidewall portions, the forward sidewall portion defining the fluid exchange aperture, and wherein the upper conduit portion extends substantially normal from the lower conduit portion towards the fluid exchange aperture to define an exhaust bore in substantial coaxial alignment with the fluid exchange aperture in the assembled arrangement, the exhaust bore being smaller than the fluid exchange aperture. In one embodiment, the fluid exchange aperture is substantially vertically aligned with the flue gas aperture, and the combustion air aperture is laterally offset from the fluid exchange aperture and the flue gas aperture. In one embodiment, the exhaust conduit generally forms an inverted L-shape sized to be disposed in the body portion.

In one embodiment, the rear sidewall portion defines a further fluid exchange aperture opposed to the fluid exchange aperture, and the housing further comprises an aperture cover sized for fluidically sealing the fluid exchange aperture or the further fluid exchange aperture, and wherein in the assembled arrangement, the upper conduit portion extends towards one of the fluid exchange aperture and the further fluid exchange aperture, and the aperture cover fluidically seals other one of the fluid exchange aperture and the further fluid exchange aperture. In one embodiment, the fluid exchange aperture and the further fluid exchange aperture have different sizes, and the housing comprises first and second said aperture covers each sized for fluidically sealing an associated one of the fluid exchange aperture and the further fluid exchange aperture. In an alternative embodiment, the fluid exchange aperture and the further fluid exchange aperture have substantially identical size, and the aperture cover is preferably shaped for snap fit engagement in the fluid exchange aperture or the further fluid exchange aperture. It is to be appreciated that other mechanisms may be utilized to removably or fixedly engaging the aperture cover, such as ball and detent, the combination of radial flanges and flange retaining slots, and the combination of threaded screws and threaded screw receiving slots.

In one embodiment, the upper conduit portion further defines a flue gas test port opposed to the exhaust bore, the flue gas test port being selectively movable between an open position and a closed position, wherein in the assembled arrangement, the test port is for positioning in the hollow interior proximal to the fluid exchange aperture when the upper conduit portion extends towards the further fluid exchange aperture, and the test port is for positioning in the hollow interior proximal to the further fluid exchange aperture when the upper conduit portion extends towards the fluid exchange aperture. In one embodiment, the water heater venting or fluid joint assembly further comprises a test port cap or plug sized for selectively fluidically sealing the test port. In one embodiment, upper conduit portion includes an internally threaded elongated section defining the flue gas test port, and the test port plug comprises an externally threaded bolt shaped for complementary threaded engagement in the elongated section. In an alternative embodiment, the housing further comprises an elongated rod extending substantially normal from a surface of the aperture cover, the elongated rod being sized to extend inwardly into the generally hollow interior for insertion into the flue gas test port when the aperture cover fluidically seals the fluid exchange aperture or the further fluid exchange aperture.

In one embodiment, the forward and rear sidewall portions cooperatively define a generally vertical inner engagement chamber above the flue gas aperture, the inner engagement chamber being shaped for at least partially receiving the lower conduit portion in complementary nested engagement therewith. In an alternative embodiment, and the lower conduit portion comprises an enlarged diameter section distal to the upper conduit portion, and the body portion further comprises an axially open exhaust conduit retaining tube extending downwardly from the lower wall to define the flue gas aperture, the retaining tube defining a generally vertical inner engagement chamber, wherein the enlarged diameter section is sized for nested engagement in the inner engagement chamber. In one embodiment, the body portion further comprises an annular rib extending around an outer periphery of the enlarged diameter section, and the exhaust conduit retaining tube defines an annular slot sized for receiving the annular rib therein in the assembled arrangement to thereby reduce or substantially prevent relative movement between the exhaust conduit and the body portion.

In one embodiment, the upper and lower walls and the sidewall are integrally joined to form the body portion in a single piece construction. In an alternative embodiment, the body portion comprises forward and rear shell casings shaped for complementary engagement therebetween to cooperatively form the body portion.

In one embodiment, the retention member comprises an outer rim, a first inner engagement hub, and two or more first support spokes each extending inwardly from the outer rim to the first inner engagement hub, the outer rim being larger than the combustion air aperture to substantially prevent passage of the retention member therethrough, and wherein the upper tubular portion comprises a second inner engagement hub and two or more second support spokes each extending inwardly from an inner surface of the upper tubular portion to the second inner engagement hub, wherein one or both of the first and second inner engagement hubs extend through the combustion air aperture to removably engage the other said engagement hub.

It is to be appreciated that the first and second inner engagement hubs are not restricted or intended to be restricted to specific embodiments, provided that the engagement hubs are cooperatively operable to engage each other, and therefore, movably hold the exhaust conduit in fluid communication with the combustion air aperture. In one embodiment, the first inner engagement hub comprises a receiver ring oriented substantially coplanar with the outer rim, and the second inner engagement hub comprises an elongated insertion member sized to be removably received in the receiver ring, wherein in the assembled arrangement, the elongated insertion member extends upwardly through the combustion air aperture for complementary mated engagement in the receiver ring. In one embodiment, the elongated insertion member is an axially open elongated insertion member having a cross section that is smaller than the combustion air aperture, the axially open elongated insertion member having a flexible upper end section comprising an outwardly extending annular flange, wherein the upper end section and the annular flange define a plurality of continuous longitudinal slots sized to permit movement of the upper end section and the annular flange through the receiver ring, and the annular flange is shaped for seated engagement on an upper periphery of the receiver ring in the assembled arrangement. Preferably, the flexible upper end section and the annular flange are configured to disengage from the receiver ring with application of a downwardly directed force thereto.

In one embodiment, the housing further comprises one or more stop projections extending downwardly around the outer periphery of the combustion air aperture in substantially abutting contact with a peripheral edge of the gasket, and wherein the upper tubular portion comprises an enlarged diameter portion provided with a contact rim defining an upper air intake bore, wherein the upper air intake bore is larger than the combustion air aperture, and the stop projection is shaped for confining the slidable movement of the contact rim relative to the gasket to reduce or substantially prevent a loss of fluid sealing contact therebetween. In one embodiment, the stop projection comprises an annular rib surrounding the gasket in substantially abutting contact with the peripheral edge of the gasket, the annular rib extending further downwardly from the outer periphery of the combustion air aperture relative to the gasket.

In one embodiment, the body portion comprises plastic forward and rear shell casings shaped for complementary engagement therebetween to cooperatively form the body portion, the body portion further comprising one or more hold down tabs extending inwardly from the casings above the combustion air aperture to maintain the retention member proximal to the inner periphery of the combustion air aperture. While the aforementioned embodiment encompasses the plastic casings, it is to be appreciated that the water heater venting assembly, the fluid joint assembly, and the components thereof are not restricted to being formed with specific materials, provided that the assemblies are operable to direct fluids. In one embodiment, the components of the water heater venting assembly or the fluid joint assembly are independently prepared with a material comprising metal, alloy, plastic, ceramics, rubber, wood, glass or a combination thereof. Preferably, the plastic comprises polyethylene terephthalate (PET), polyethylene (PE), high-density polyethylene (HDPE), low-density polyethylene (LDPE), polyvinyl chloride (PVC), chlorinated polyvinyl chloride (CPVC), polypropylene (PP), polystyrene (PS), high impact polystyrene (HIPS), acrylonitrile butadiene styrene (ABS), polycarbonate or a combination thereof. In one embodiment, the gasket is prepared with rubber or solid foam, and the remaining components of the water heater venting assembly or the fluid joint assembly are prepared with PVC, CPVC or a combination thereof.

In one embodiment, the body portion comprises a first wall defining the first duct coupling aperture and the second duct coupling aperture, a second wall generally opposed to the first wall, and a sidewall coupled to the first wall and the second wall, the sidewall having opposed first and second sidewall portions, wherein the first sidewall portion defines the coaxial pipe coupling aperture, and the first conduit portion extends substantially normal from the second conduit portion towards the coaxial pipe coupling aperture to define an exhaust bore in substantial coaxial alignment with the coaxial pipe coupling aperture in the assembled arrangement, the exhaust bore being smaller than the coaxial pipe coupling aperture.

In one embodiment, the second sidewall portion defines a further coaxial pipe coupling aperture opposed to the coaxial pipe coupling aperture, and the housing further comprises an aperture cover sized for fluidically sealing the coaxial pipe coupling aperture or the further coaxial pipe coupling aperture, and wherein in the assembled arrangement, the first conduit portion extends towards one of the coaxial pipe coupling aperture and the further coaxial pipe coupling aperture, and the aperture cover fluidically seals other one of the coaxial pipe coupling aperture and the further coaxial pipe coupling aperture.

In one embodiment, the first conduit portion further defines a flue gas test port opposed to the exhaust bore, the flue gas test port being selectively movable between an open position and a closed position, wherein in the assembled arrangement, the test port is for positioning in the hollow interior proximal to the coaxial pipe coupling aperture when the first conduit portion extends towards the further coaxial pipe coupling aperture, and the test port is for positioning in the hollow interior proximal to the further coaxial pipe coupling aperture when the first conduit portion extends towards the coaxial pipe coupling aperture.

In one embodiment, the first and second sidewall portions cooperatively define an inner engagement chamber extending inwardly from the flue gas aperture towards the coaxial pipe coupling aperture or the further coaxial pipe coupling aperture, the inner engagement chamber being shaped for at least partially receiving the second conduit portion in complementary nested engagement therewith.

In one embodiment, the retention member comprises an outer rim, a first inner engagement hub, and two or more first support spokes each extending inwardly from the outer rim to the first inner engagement hub, the outer rim being larger than the first duct coupling aperture to substantially prevent passage of the retention member therethrough, and wherein the second tubular portion comprises a second inner engagement hub and two or more second support spokes each extending inwardly from an inner surface of the second tubular portion to the second inner engagement hub, wherein one or both of the first and second inner engagement hubs extend through the first duct coupling aperture to removably engage the other said engagement hub.

In one embodiment, the first inner engagement hub comprises a receiver ring oriented substantially coplanar with the outer rim, and the second inner engagement hub comprises an elongated insertion member sized to be removably received in the receiver ring, wherein in the assembled arrangement, the elongated insertion member extends through the first duct coupling aperture for complementary mated engagement in the receiver ring.

In one embodiment, the housing further comprises one or more stop flanges located around the outer periphery of the first duct coupling aperture in substantially abutting contact with a peripheral edge of the gasket, and wherein the second tubular portion comprises an enlarged diameter portion provided with a contact rim defining an air intake bore, wherein the air intake bore is larger than the first duct coupling aperture, and the stop flange is shaped for confining the slidable movement of the contact rim relative to the gasket to reduce or substantially prevent a loss of fluid sealing contact therebetween.

In one embodiment, the body portion comprises first and second plastic shell casings shaped for complementary engagement therebetween to cooperatively form the body portion, the body portion further comprising one or more hold down tabs extending inwardly from the casings proximal to the first duct coupling aperture to maintain the retention member proximal to the inner periphery of the first duct coupling aperture.

It is to be appreciated that the water heater venting assembly, the fluid joint assembly, and the components thereof are not restricted to having specific shapes or dimensions, and may be configured to different shapes and dimensions depending on for example the water heater, the inlet/outlet ducts, the combustion air supply/flue gas venting pipes, the coaxial fluid pipe, and the residential building. In view of a majority of commercially available heaters provided with combustion air inlet/flue gas outlet ducts having a generally circular cross section, the combustion air aperture, the flue gas aperture, the flue gas exhaust conduit, the tubular member, the first/second duct coupling aperture, the connecting conduit and the first duct coupling aperture preferably includes a generally circular cross section, although the foregoing components may in the alternative have a cross section of other shapes including a triangle, a square, a rectangle, an oval and an octagon. Furthermore, the dimensions of for example the housing and the body portion, and the exhaust/connecting conduit may be selected depending on the specific required fluid flow rates.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
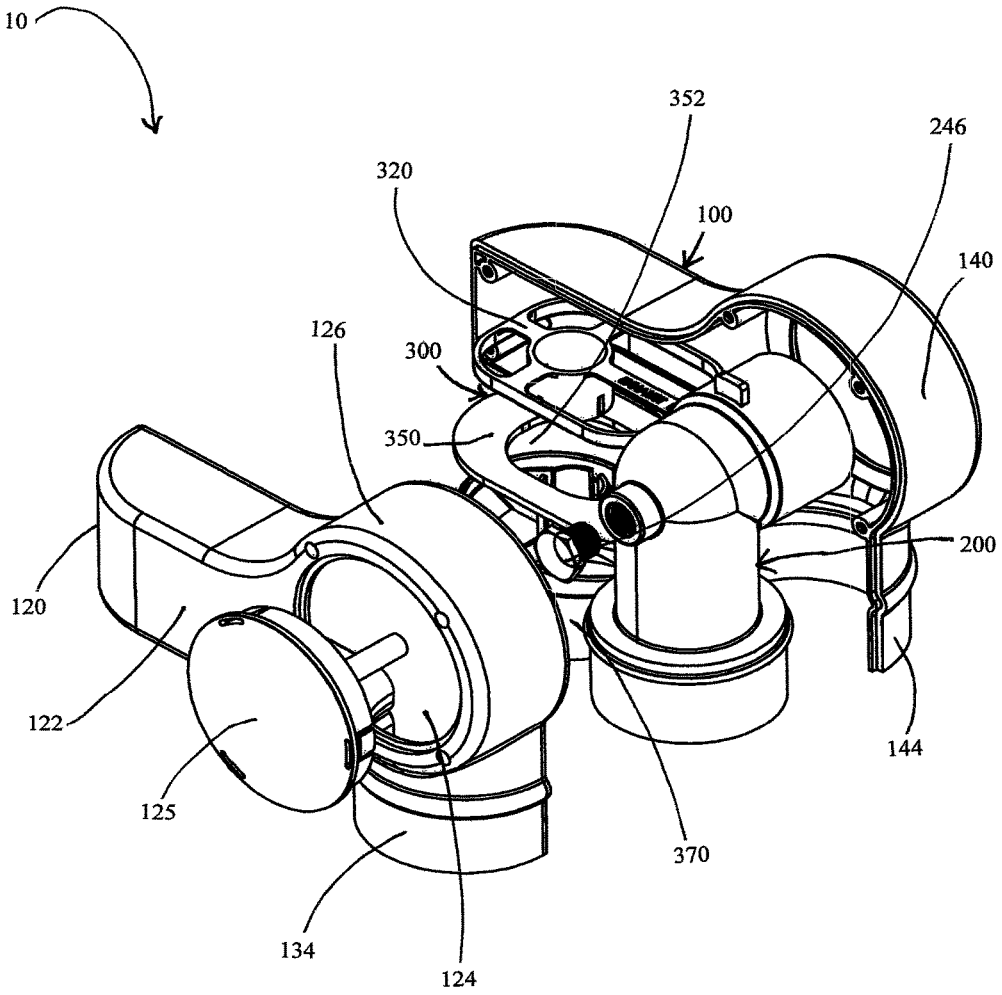
FIG. 1 is an exploded perspective view of a water heater venting assembly in accordance with a preferred embodiment of the present invention.

Reference is made to FIG. 1 which shows an exploded perspective view of a water heater venting assembly 10 for communicating a flue gas and a combustion air between a residential water heater and an outdoor atmosphere, in accordance with a preferred embodiment of the present invention. In the construction shown, and as will be further described below, the water heater venting assembly 10 includes a generally hollow assembly housing 100, a flue gas exhaust conduit 200 and a movable inlet duct coupling assembly 300, where both the conduit 200 and the inlet duct coupling assembly 300 are shaped for placement in or attachment to or near the assembly housing 100. For more complete illustration, the venting assembly 10 is shown in an exploded view with the assembly housing 100 in a disassembled arrangement to reveal the included conduit 200 and the coupling assembly 300, and without the water heater.

Figure 2:
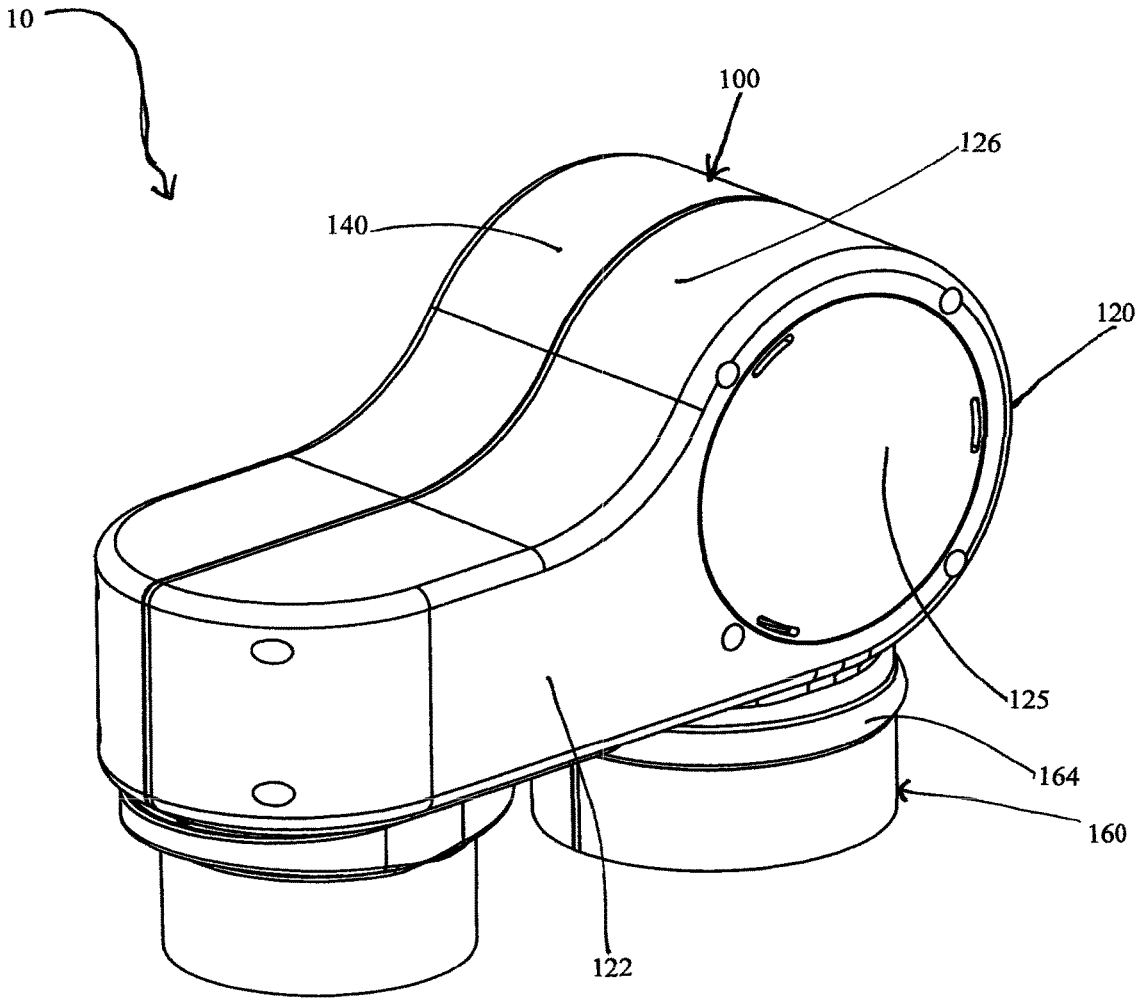
FIG. 2 is a perspective view of the water heater venting assembly shown in FIG. 1.
Figure 3A:
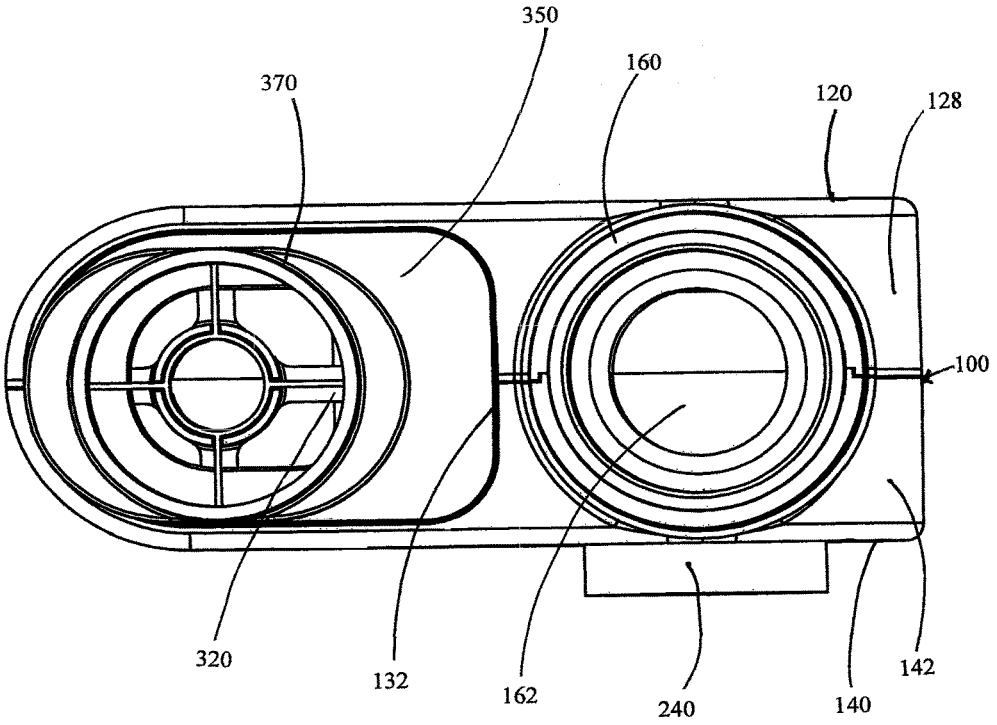
FIG. 3A is a bottom view of the water heater venting assembly shown in FIG. 1.

The assembly housing 100 includes opposed lateral housing shell casings 120, 140 shaped to combine together to cooperatively form a clamshell body portion, as more clearly shown in FIG. 2. The housing shell casing 120 includes a laterally oriented sidewall 122 defining a gas exchange aperture 124 sized for fluid communication with a coaxial fluid pipe 400, as will be further discussed below, and the assembly housing 100 is further provided with a gas exchange aperture cover or cap 125 sized to be removably received in the aperture 124 by complementary snap-fit engagement. The shell casing 120 further includes an upper casing wall 126 and a lower casing wall 128 as seen in FIG. 3A, each integrally coupled to the sidewall 122.

The other shell casing 140 is identical to the shell casing 120, with the exception that the former forms a mirrored image of the latter, and includes all components (including an associated gas exchange aperture cover or cap) described above in respect of the casing 120 in mirrored positions with substantially identical dimensions.

Figure 3B:
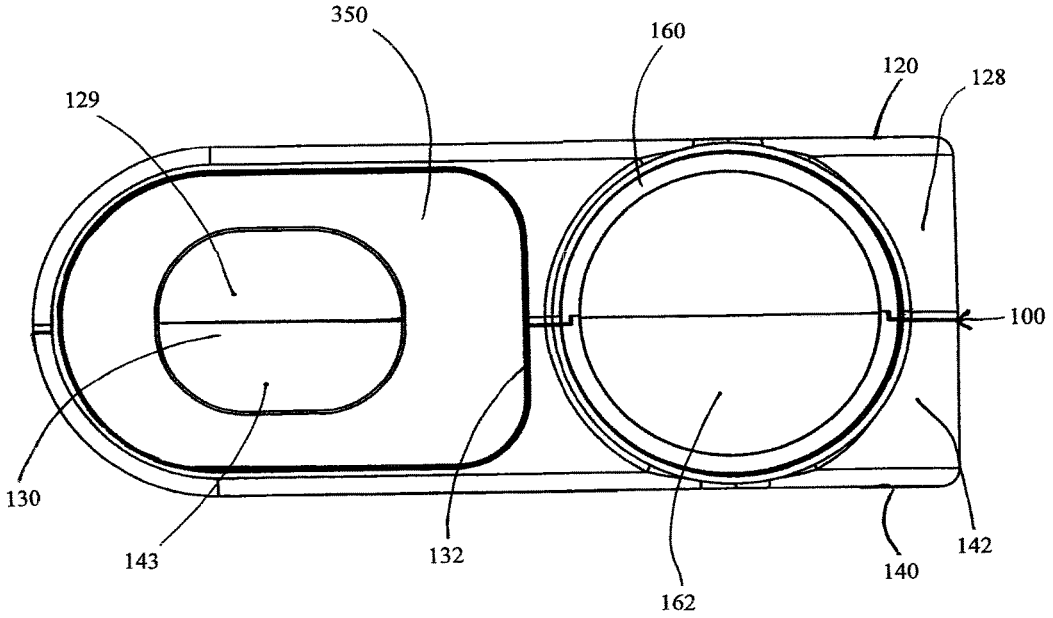
FIG. 3B is a bottom view of an assembly housing included with the water heater venting assembly shown in FIG. 1, and which is seen with a resiliently deformable gasket also included with the water heater venting assembly attached to the assembly housing.

The respective lower casing walls 126, 142 of the casings 120, 140 define respective half circle openings 129, 143 which when combined cooperatively define a downwardly open combustion air aperture 130 as seen in FIG. 3B, and which is vertically offset from the gas exchange aperture 124. The casings 120, 140 cooperatively form a downwardly extending annular stop projection or fence 132 located outwardly around the combustion air aperture 130. As seen in FIGS. 1 and 2, the respective sidewalls of the casings 120, 140 extend downwardly past the combustion air aperture 130 directly below the gas exchange aperture 124 to form respective conduit engagement portions 134, 144 which when combined cooperatively form a conduit engagement chamber or tube 160 which opens to a downwardly open flue gas aperture 162. The conduit engagement tube 160 is formed with an inner annular recess 164 shaped for retaining the flue gas exhaust conduit 200, as will be further described below.

Figure 4:
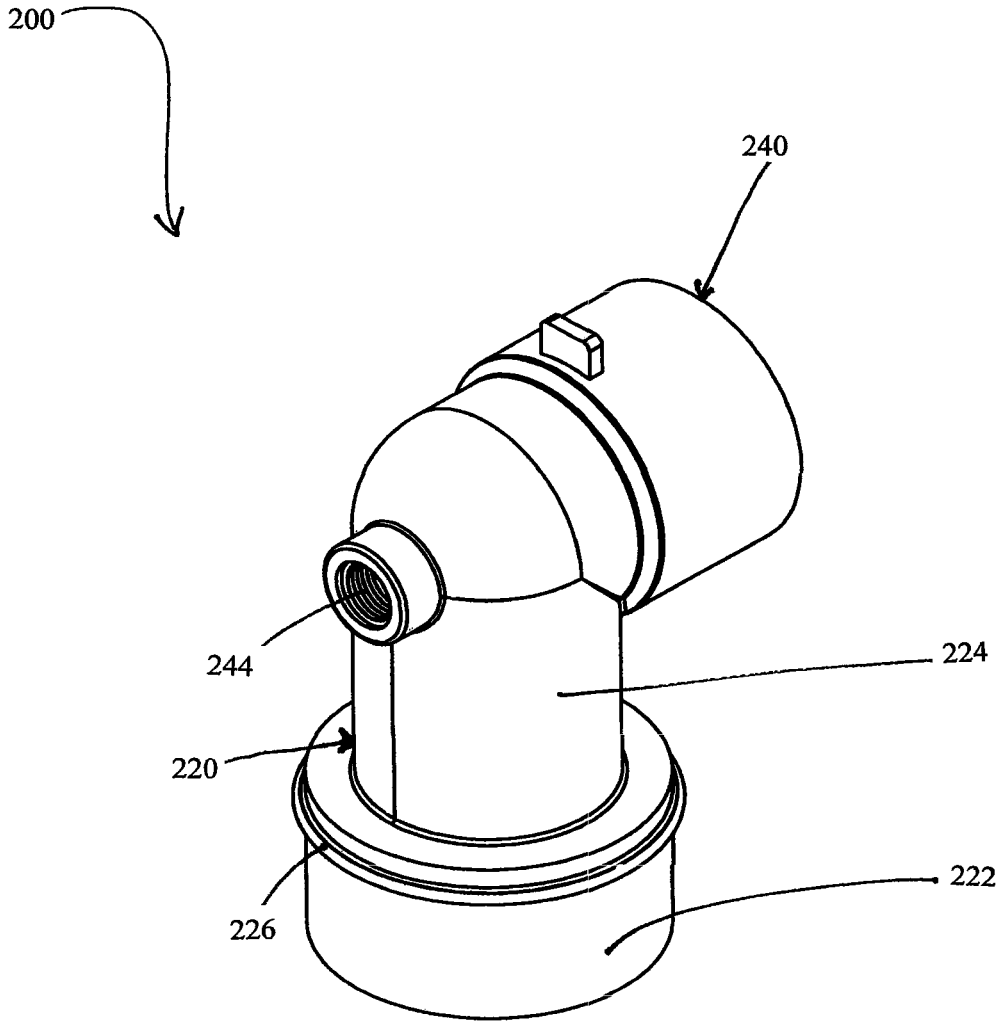
FIG. 4 is a perspective view of a flue gas exhaust conduit included in the water heater venting assembly shown in FIG. 1.
Figure 5:
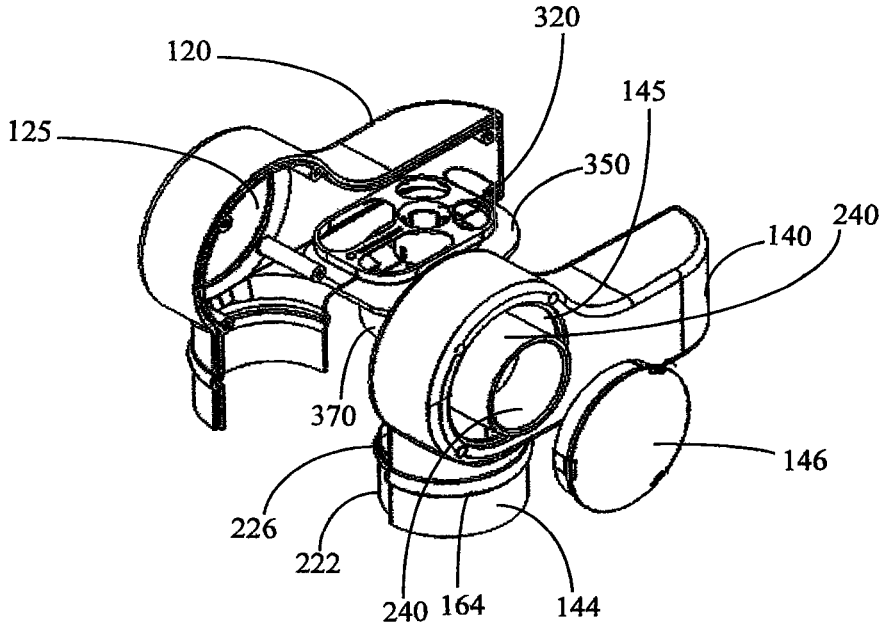
FIG. 5 is another exploded perspective view of the water heater venting assembly shown in FIG. 1.

Reference is made to FIG. 4 which shows a perspective view of the flue gas exhaust conduit 200. The flue gas exhaust conduit 200 is formed as an inverted L-shaped conduit provided with a generally vertically oriented lower conduit portion 220 and a generally horizontally oriented upper conduit portion 240 integrally and fluidically coupled to the lower conduit portion 220. The lower conduit portion 220 includes an enlarged diameter portion 222 sized for fitted engagement with a flue gas outlet duct of the residential water heater, as will be further described below, and a reduced diameter portion 224 fluidically coupled to the upper conduit portion 240. Extending laterally from an uppermost end of the enlarged diameter portion 222 and below the upper conduit portion 240 is an annular protrusion 226 sized to be received in the annular recess 164. The upper conduit portion 240 opens to a laterally open exhaust bore 242 having a diameter smaller than that of a gas exchange aperture 145 defined by the respective sidewall of the shell casing 140, as seen in FIG. 5. Opposed to the exhaust bore 242 is an internally threaded flue gas test port 244 having a diameter smaller than that of the exhaust bore 242. The exhaust conduit 200 is further provided with an externally threaded test port bolt plug 246 sized for removable insertion into the exhaust bore 242 in complementary threaded engagement therewith.

Figure 6:
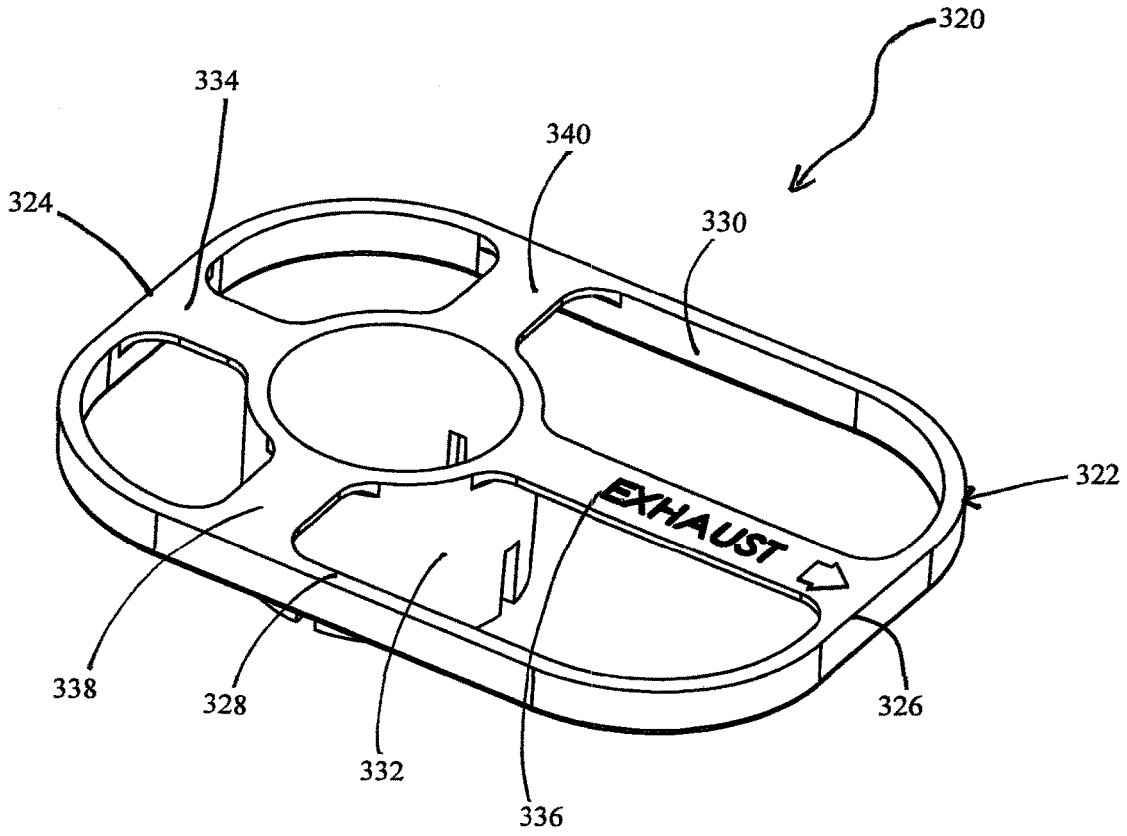
FIG. 6 is a perspective view of a retention member included with the water heater venting assembly shown in FIG. 1.

The movable inlet duct coupling assembly 300 includes a retention member 320, a resiliently deformable gasket 350 and an axially open tubular member 370. As more clearly seen in FIG. 6, the retention member 320 is constructed with a generally planar outer rim or frame 322 of rectangular shape provided with dimensions larger than the combustion air aperture 130, and which includes a pair of opposed transverse frame members 324, 326 and a pair of opposed longitudinal frame members 328, 330. The retention member 320 also includes a first inner engagement hub, ring or receiving barrel 332 generally offset longitudinally from a center of the outer frame 322. The receiving barrel 332 is coupled to the outer frame 322 in the offset position with longitudinally extending support spokes 334, 336 extending between the associated transverse frame members 324, 326 and an outer periphery of the barrel 332, and transversely extending support spokes 338, 340 extending between the associated longitudinal frame members 328, 330 and the outer periphery of the barrel 332. The receiving barrel 332 extends further downwardly from a plane of the outer frame 322, and has an outer diameter smaller than that of the combustion air aperture 130.

The gasket 350 is sized and shaped for application or attachment to an outer surface of the respective lower casing walls of the housing shell casings 120, 140 around the outer periphery of the combustion air aperture 130 in abutting engagement with the annular stop fence 132, as will be further discussed below. The gasket 350 defines an opening 352 of substantially identical shape and size as those of the combustion air aperture 130, and is made with resiliently deformable rubber or foam material.

Figure 7:
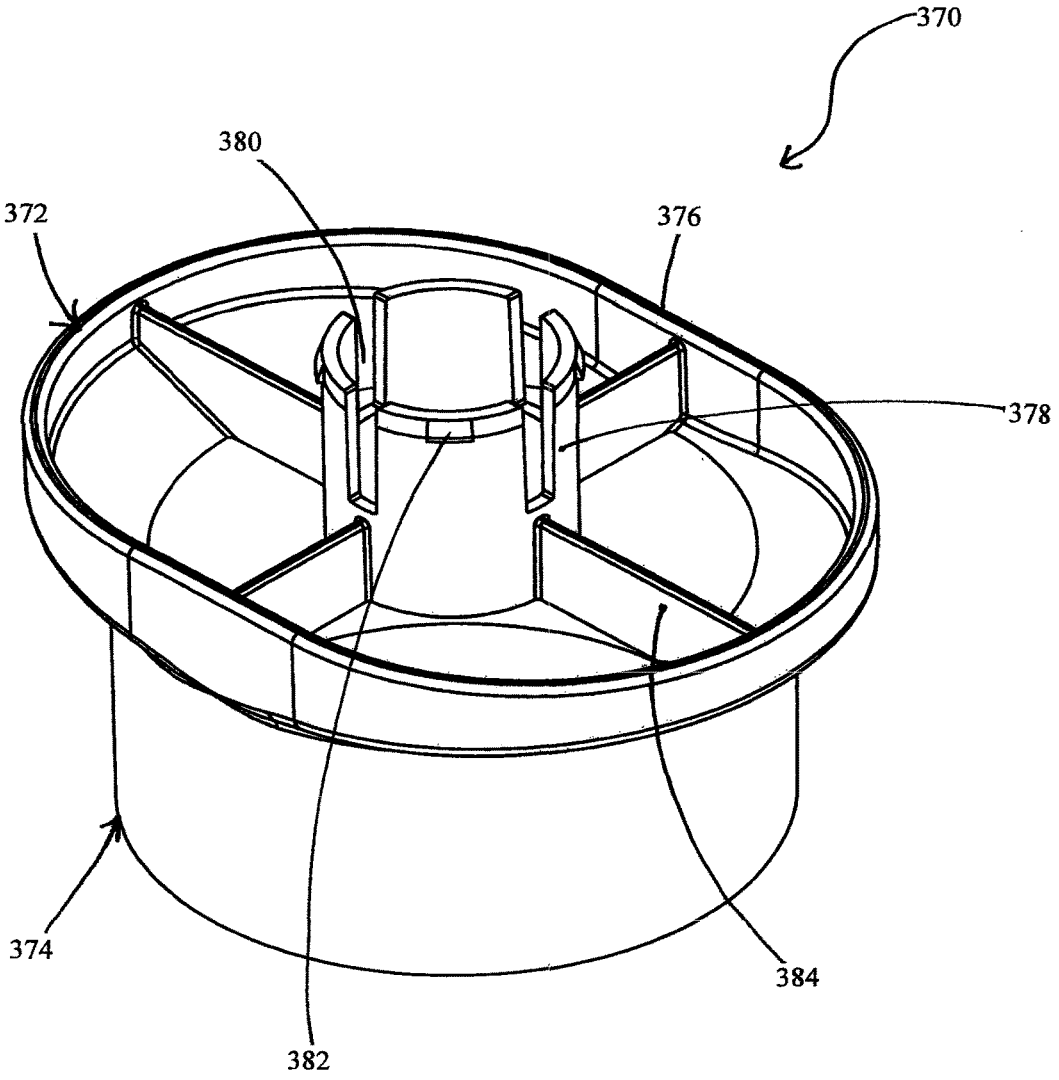
FIG. 7 is a perspective view of an axially open tubular member included with the water heater venting assembly shown in FIG. 1.

Reference is made to FIG. 7 which shows a perspective view of the axially open tubular member 370. The tubular member 370 broadly includes an upper tubular portion 372 and a lower tubular portion 374 in fluid communication with the upper tubular portion 372. The lower tubular portion 374 is sized for fluid communication with a combustion air inlet duct of the water heater, as will be further discussed below. The upper tubular portion 372 tapers outwardly and upwardly from the lower tubular portion 374 to form an upper engagement rim 376 of generally oval shape, and which is larger than the combustion air aperture 130. Further included with the tubular member 370 is a second inner engagement hub or insertion member or barrel 378 extending further upwardly from and substantially concentric with the upper engagement rim 376. The insertion barrel 378 defines multiple longitudinally extending slots 380 at regular intervals around the circumference of the barrel 378 to permit inward annular compression against resilient bias of the insertion barrel 378. The insertion barrel 378 includes multiple uppermost end engagement flanges 382 extending outwardly from the barrel 378 for snap-fit engagement with the receiving barrel 332, as will be further described below. The insertion barrel 378 is coupled to the upper engagement rim 376 with multiple support spokes 384 extending inwardly from an inner annular surface of the rim 376 to an outer periphery of the barrel 378.

All components of the water heater venting assembly 10 are constructed as injection molded polyvinyl chloride and/or chlorinated polyvinyl chloride components, with the exception of the resiliently deformable gasket 350 prepared as a sponge pad.

For assembly, as seen in FIG. 5 the retention member 320 is placed in an interior space defined by the housing shell casing 120 such that the plane of the outer frame 322 is substantially coplanar with the lower casing wall 128, and the receiving barrel 332 extends downwardly past the half circle opening 129 defined by the lower casing wall 128. The enlarged diameter portion 222 is nested against an inward surface of the conduit engagement portion 144 with the annular protrusion 226 inserted into the annular recess 164, such that the reduced diameter portion 224 extends towards the gas exchange aperture 145, and the upper conduit portion 240 extends outwardly past the aperture 145 (and the gas exchange aperture cap 146 is removed from the aperture 145). The gasket 350 is applied to an outer surface of the lower casing wall 128 with a portion of the outer periphery of the gasket 350 adjacent to the wall 128 abutting against the annular stop fence 132 extending downwardly from the wall 128. The insertion barrel 378 is inserted into the receiving barrel 332 until the engagement flanges 382 are engaged in or over the receiving barrel 332, thereby removably coupling the tubular member 370 to the retention member 320, and the engagement rim 376 is urged towards the lower casing wall 128 against resilient bias of the gasket 350.

Then the other housing shell casing 140 is combined with the casing 120, such that: i) the enlarged diameter portion 222 is nested in the conduit engagement tube 160; ii) the gasket 350 is applied to an outer surface of the respective lower casing walls 128, 142 of the casings 120, 140 with the outer periphery of the gasket 350 abutting against the annular stop fence 132; and iii) the engagement rim 376 is urged against the walls 128, 142 around the combustion air aperture 130 against the resilient bias of the gasket 350 in fluid sealing contact therewith. The gas exchange aperture cap 125 is pressed into the gas exchange aperture 124 with the test port bolt plug 246 received in the flue gas test port 244 in threaded engagement therewith.

For installation on the water heater, the lateral distance between the included flue gas outlet duct and the combustion air inlet duct are measured, and the relative distance between the enlarged diameter portion 222 and the tubular member 370 is adjusted to match the lateral distance by sliding the tubular member 370 towards or away from the enlarged diameter portion 222. As described above, the outer frame 322 is dimensioned larger than the combustion air aperture 130, such that the frame 322 does not pass through the aperture 130 during the sliding movement of the tubular member 370 coupled to the retention member 320. similarly, the upper engagement rim 376 is larger than the combustion air aperture 130, and the annular stop fence 132 is sized to prevent excess sliding movement of the rim 376 over the gasket 350 relative to the combustion air aperture 130 where the aperture 130 is no longer completely overlapped within the rim 376, and a combustion air leak occurs between the aperture 130 and the rim 376. Once properly adjusted, the enlarged diameter portion 222 and the lower tubular portion 374 respectively are fluidically coupled to the flue gas outlet duct and the combustion air inlet duct.

Figure 8:
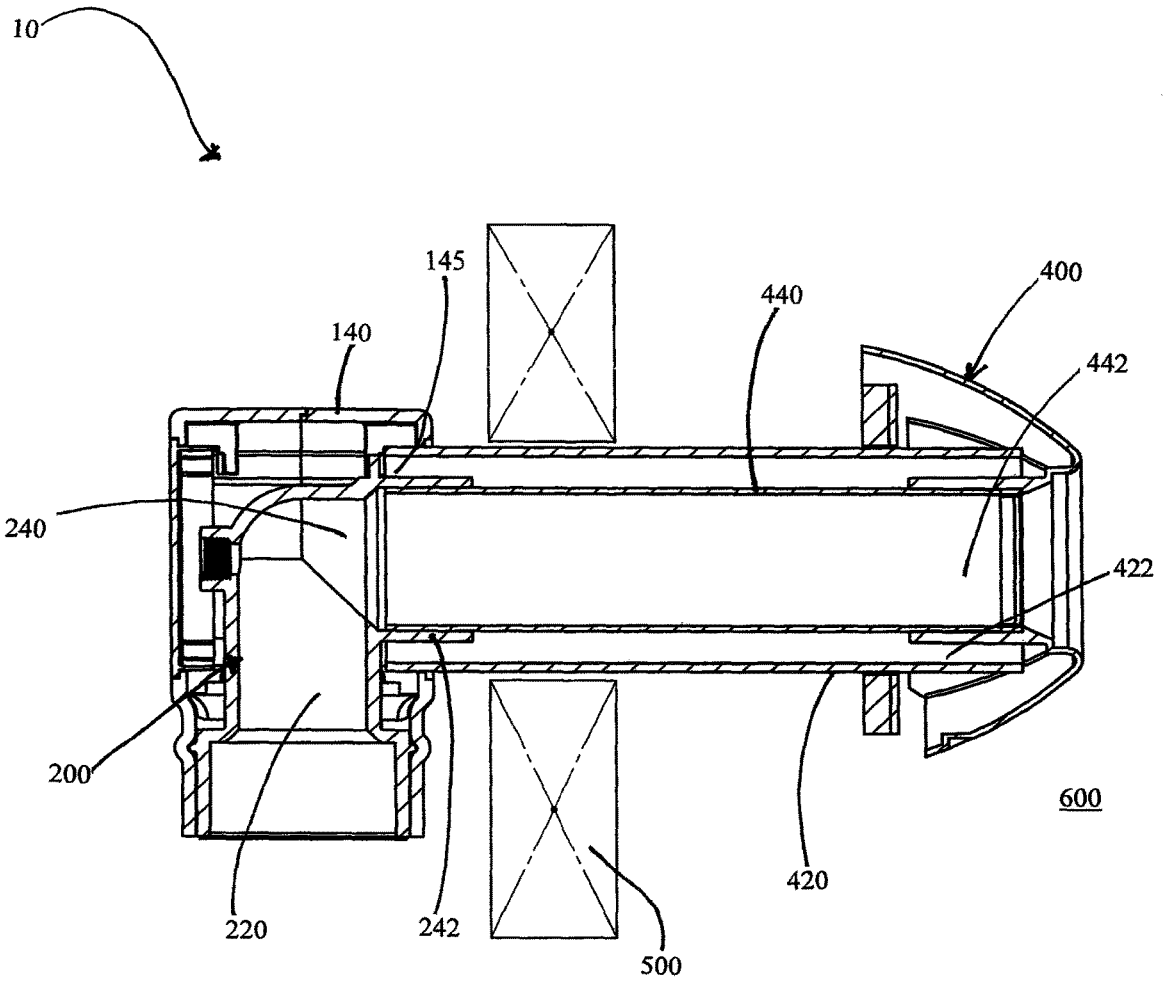
FIG. 8 is a lateral cross-sectional view of the water heater venting assembly shown in FIG. 1 in operation with a fluidically coupled coaxial fluid pipe extending through an exterior wall.

Reference is made to FIG. 8 which shows a lateral cross-sectional view of the water heater venting assembly 10 in fluid communication with the coaxial fluid pipe 400. The coaxial fluid pipe 400 has an outer combustion gas intake pipe 420 and an inner flue gas exhaust pipe 440 disposed concentrically within the pipe 420. The upper conduit portion 240 is fluidically coupled at the exhaust bore 242 to the inner exhaust pipe 440, and the housing shell casing 140 at the gas exchange aperture 145 to the outer intake pipe 420. The coaxial fluid pipe 400 is positioned to extend through a bore defined by an exterior wall 500 of a building to an outdoor atmosphere 600 to effect fluid communication of a combustion air from the outdoor atmosphere 600 to the water heater, and a flue gas from the water heater to the outdoor atmosphere 600. During operation, the combustion air enters through an outer channel 422 defined between the outer intake pipe 420 and the inner exhaust pipe 440, then through a housing interior cooperatively defined by the housing shell casings 120, 140, and then through the tubular member 370 to the combustion air inlet duct. The flue gas exiting from the water heater through the flue gas outlet duct is communicated through the flue gas exhaust conduit 200, then through an inner channel 442 defined by the inner exhaust pipe 440, and is expelled to the outdoor atmosphere 600.

The applicant has appreciated that the water heater venting assembly 10 provided with the movable inlet duct coupling assembly 300 may advantageously permit fluid communication between the coaxial fluid pipe 400 and water heaters of varying lateral distances between the included flue gas outlet duct and combustion air inlet duct, without necessarily requiring more time consuming and less cost effective customized fabrication on a case-by-case basis. Rather, as described above with sliding movement of the tubular member 370 relative to the lower conduit portion 220 the water heater venting assembly 10 allows for simpler adjustments to work with different water heaters.

The water heater venting assembly 10 also allows for collection or testing of a flue gas generated by the water heater by disengaging the gas exchange aperture cap 125 from the gas exchange aperture 124, as well as the test port bolt plug 246 from the flue gas test port 244 to permit flow of the flue gas from the water heater therethrough.

Figure 9:
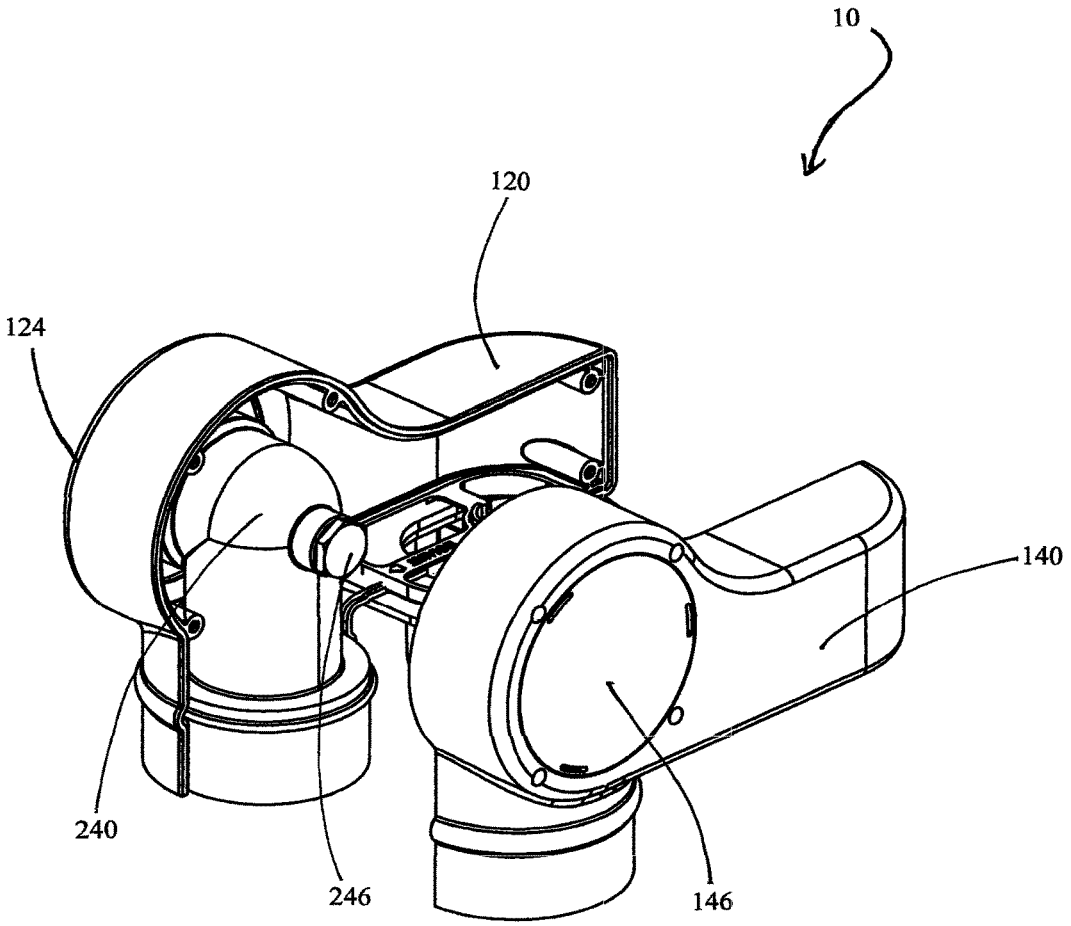
FIG. 9 is an exploded perspective view of a water heater venting assembly in accordance with an alternative embodiment of the present invention.
Figure 10:
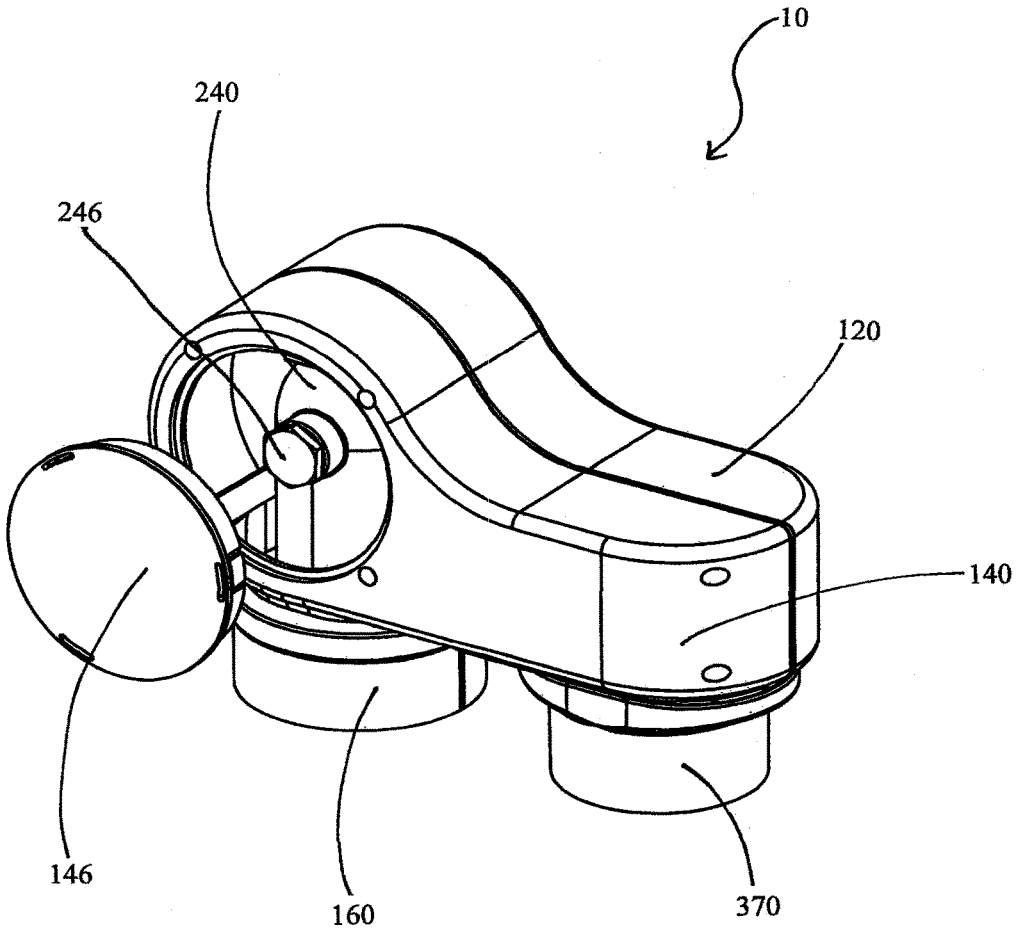
FIG. 10 is a perspective view of the water heater venting assembly shown in FIG. 9, and which is seen with an included gas exchange aperture cover or cap removed from a gas exchange aperture.

Reference is made to FIG. 9 which shows an exploded perspective view of an alternative arrangement of the water heater venting assembly 10. As seen in FIG. 9, the combination of the housing shell casings 120, 140 permits for reversible orientation of the upper conduit portion 240 to extend towards or through the gas exchange aperture 124 of the casing 120, instead of the gas exchange aperture 145 of the casing 140. In such reversed orientation, the gas exchange aperture cap 125 is removed, and the cap 146 is pressed into the gas exchange aperture 145 to fluidically seal the aperture 145. As seen in FIG. 10, to collect or test a flue gas generated by the water heater, the gas exchange aperture cap 146 can be removed from the gas exchange aperture 145 to reveal the test port bolt plug 246, and the bolt plug 246 can be subsequently removed to extract the flue gas in the exhaust conduit 200.

While the invention has been described with reference to preferred embodiments, the invention is not or intended by the applicant to be so limited. A person skilled in the art would readily recognize and incorporate various modifications, additional elements and/or different combinations of the described components consistent with the scope of the invention as described herein. For instance, it is to be appreciated while the water heater venting assembly 10 has been described for specific use with the water heater, the assembly 10 is configurable to operate more generally as a fluid joint assembly to fluidically couple first and second fluid ducts laterally spaced from each other and the coaxial fluid pipe 400 not necessarily intended for communicating a combustion air and a flue gas for a water heater.

We claim:

1. A water heater venting assembly for directing a flue gas and a combustion air between a water heater and an outdoor atmosphere, the water heater having an upper heater portion, a flue gas outlet duct and a combustion air inlet duct, wherein each said duct extends generally upwardly from the upper heater portion at a lateral distance from the other duct, and wherein the venting assembly comprises a generally hollow housing, a flue gas exhaust conduit at least partially disposed in the housing, and an adjustable inlet duct coupling assembly movably coupled to the housing, wherein:

the flue gas exhaust conduit comprises a generally vertically oriented lower conduit portion and an upper conduit portion in fluid communication with the lower conduit portion, the lower conduit portion being sized for fitted engagement with the flue gas outlet duct in fluid communication therewith to effect directing of the flue gas from the water heater towards the upper conduit portion;

the housing comprises a body portion defining a downwardly open combustion air aperture, a downwardly open flue gas aperture, a laterally or upwardly open fluid exchange aperture and a generally hollow interior in fluid communication with each said aperture, the flue gas aperture being sized to receive the lower conduit portion therethrough in an assembled arrangement, whereby the exhaust conduit is at least partially disposed in the hollow interior with the upper conduit portion positioned proximal to the fluid exchange aperture; and the coupling assembly comprises a retention member, a resiliently deformable gasket for placement on the body portion around an outer periphery of the combustion air aperture, and an axially open tubular member comprising an upper tubular portion and a lower tubular portion in fluid communication with the upper tubular portion, the lower tubular portion being sized for fitted engagement with the combustion air inlet duct in fluid communication therewith, wherein in the assembled arrangement, the retention member is for placement in the hollow interior in at least partial abutting contact with an inner periphery of the combustion air aperture to movably hold the upper tubular portion in seated fluid sealing engagement against bias of the gasket around the outer periphery, thereby fluidically coupling the tubular member and the combustion air aperture, and wherein the retention member is sized to permit slidable movement of the upper tubular portion relative to the gasket about the combustion air aperture to thereby allow the engagement between the lower tubular portion and the inlet duct at the lateral distance from the outlet duct; and wherein the fluid exchange aperture is sized to fluidically couple to a combustion air supply pipe extending towards the outdoor atmosphere, and the upper conduit portion is sized to fluidically couple to a flue gas venting pipe disposed in the supply pipe.

2. The venting assembly of claim 1, wherein the body portion comprises an upper wall, a lower wall defining the combustion air aperture and the flue gas aperture, and a sidewall having opposed forward and rear sidewall portions, the forward sidewall portion defining the fluid exchange aperture, and wherein the upper conduit portion extends substantially normal from the lower conduit portion towards the fluid exchange aperture to define an exhaust bore in substantial coaxial alignment with the fluid exchange aperture in the assembled arrangement, the exhaust bore being smaller than the fluid exchange aperture.

3. The venting assembly of claim 2, wherein the rear sidewall portion defines a further fluid exchange aperture opposed to the fluid exchange aperture, and the housing further comprises an aperture cover sized for fluidically sealing the fluid exchange aperture or the further fluid exchange aperture, and wherein in the assembled arrangement, the upper conduit portion extends towards one of the fluid exchange aperture and the further fluid exchange aperture, and the aperture cover fluidically seals other one of the fluid exchange aperture and the further fluid exchange aperture.

4. The venting assembly of claim 3, wherein the upper conduit portion further defines a flue gas test port opposed to the exhaust bore, the flue gas test port being selectively movable between an open position and a closed position, wherein in the assembled arrangement, the test port is for positioning in the hollow interior proximal to the fluid exchange aperture when the upper conduit portion extends towards the further fluid exchange aperture, and the test port is for positioning in the hollow interior proximal to the further fluid exchange aperture when the upper conduit portion extends towards the fluid exchange aperture.

5. The venting assembly of claim 2, wherein the forward and rear sidewall portions cooperatively define a generally vertical inner engagement chamber above the flue gas aperture, the inner engagement chamber being shaped for at least partially receiving the lower conduit portion in complementary nested engagement therewith.

6. The venting assembly of claim 1, wherein the retention member comprises an outer rim, a first inner engagement hub, and two or more first support spokes each extending inwardly from the outer rim to the first inner engagement hub, the outer rim being larger than the combustion air aperture to substantially prevent passage of the retention member therethrough, and wherein the upper tubular portion comprises a second inner engagement hub and two or more second support spokes each extending inwardly from an inner surface of the upper tubular portion to the second inner engagement hub, wherein one or both of the first and second inner engagement hubs extend through the combustion air aperture to removably engage the other said engagement hub.

7. The venting assembly of claim 6, wherein the first inner engagement hub comprises a receiver ring oriented substantially coplanar with the outer rim, and the second inner engagement hub comprises an elongated insertion member sized to be removably received in the receiver ring, wherein in the assembled arrangement, the elongated insertion member extends upwardly through the combustion air aperture for complementary mated engagement in the receiver ring.

8. The venting assembly of claim 1, wherein the housing further comprises one or more stop projections extending downwardly around the outer periphery of the combustion air aperture in substantially abutting contact with a peripheral edge of the gasket, and wherein the upper tubular portion comprises an enlarged diameter portion provided with a contact rim defining an upper air intake bore, wherein the upper air intake bore is larger than the combustion air aperture, and the stop projection is shaped for confining the slidable movement of the contact rim relative to the gasket to reduce or substantially prevent a loss of fluid sealing contact therebetween.

9. The venting assembly of claim 1, wherein the body portion comprises plastic forward and rear shell casings shaped for complementary engagement therebetween to cooperatively form the body portion.

10. A water heater venting assembly for directing a flue gas and a combustion air between a water heater and an outdoor atmosphere, the water heater having an upper heater portion, a flue gas outlet duct and a combustion air inlet duct, wherein each said duct extends generally upwardly from the upper heater portion at a lateral distance from the other duct, and wherein the venting assembly comprises a generally hollow housing, a flue gas exhaust conduit at least partially disposed in the housing, and an adjustable inlet duct coupling assembly movably coupled to the housing, wherein:

the flue gas exhaust conduit comprises a generally vertically oriented lower conduit portion and an upper conduit portion in fluid communication with the lower conduit portion, the lower conduit portion being shaped for fluid communication with the flue gas outlet duct to effect directing of the flue gas from the water heater towards the upper conduit portion;

the housing comprises a body portion defining a downwardly open combustion air aperture, a downwardly open flue gas aperture, a laterally open fluid exchange aperture and a generally hollow interior in fluid communication with each said aperture, the flue gas aperture being sized to receive the lower conduit portion therethrough in an assembled arrangement, whereby the exhaust conduit is at least partially disposed in the hollow interior with the upper conduit portion positioned proximal to the fluid exchange aperture; and the coupling assembly comprises a retention member, a resiliently deformable gasket for placement on the body portion around an outer periphery of the combustion air aperture, and an axially open tubular member comprising an upper tubular portion and a lower tubular portion in fluid communication with the upper tubular portion, the lower tubular portion being shaped for fluid communication with the combustion air inlet duct, wherein the retention member comprises an outer rim, a receiver ring, and two or more first support spokes each extending inwardly from the outer rim to the receiver ring, and wherein the upper tubular portion comprises an inner elongated cylindrical member sized to be removably received in the receiver ring and two or more second support spokes each extending inwardly from an inner surface of the upper tubular portion to the elongated cylindrical member;

wherein in the assembled arrangement, the retention member is for placement in the hollow interior with the outer rim in at least partial abutting contact with an inner periphery of the combustion air aperture and the elongated cylindrical member removably received in the receiver ring, thereby movably holding the upper tubular portion in seated fluid sealing engagement against bias of the gasket around the outer periphery to fluidically couple the tubular member and the combustion air aperture, and wherein the outer rim is sized to permit slidable movement of the upper tubular portion relative to the gasket about the combustion air aperture to thereby allow the fluid communication between the lower tubular portion and the inlet duct at the lateral distance from the outlet duct, and wherein the fluid exchange aperture is sized to fluidically couple to a combustion air supply pipe extending towards the outdoor atmosphere, and the upper conduit portion is sized to fluidically couple to a flue gas venting pipe disposed in the supply pipe.

11. The venting assembly of claim 10, wherein the body portion comprises an upper wall, a lower wall defining the combustion air aperture and the flue gas aperture, and a sidewall having opposed forward and rear sidewall portions, the forward sidewall portion defining the fluid exchange aperture, and wherein the upper conduit portion extends substantially normal from the lower conduit portion towards the fluid exchange aperture to define an exhaust bore in substantial coaxial alignment with the fluid exchange aperture in the assembled arrangement, the exhaust bore being smaller than the fluid exchange aperture.

12. The venting assembly of claim 11, wherein the rear sidewall portion defines a further fluid exchange aperture opposed to the fluid exchange aperture, and the housing further comprises an aperture cover sized for fluidically sealing the fluid exchange aperture or the further fluid exchange aperture, and wherein in the assembled arrangement, the upper conduit portion extends towards one of the fluid exchange aperture and the further fluid exchange aperture, and the aperture cover fluidically seals other one of the fluid exchange aperture and the further fluid exchange aperture.

13. The venting assembly of claim 12, wherein the upper conduit portion further defines a flue gas test port opposed to the exhaust bore, the flue gas test port being selectively movable between an open position and a closed position, wherein in the assembled arrangement, the test port is for positioning in the hollow interior proximal to the fluid exchange aperture when the upper conduit portion extends towards the further fluid exchange aperture, and the test port is for positioning in the hollow interior proximal to the further fluid exchange aperture when the upper conduit portion extends towards the fluid exchange aperture.

14. The venting assembly of claim 11, wherein the forward and rear sidewall portions cooperatively define a generally vertical inner engagement chamber above the flue gas aperture, the inner engagement chamber being shaped for at least partially receiving the lower conduit portion in complementary nested engagement therewith.

15. The venting assembly of claim 10, wherein the receiver ring is oriented substantially coplanar with the outer rim, and wherein in the assembled arrangement, the elongated cylindrical member extends upwardly through the combustion air aperture for complementary mated engagement in the receiver ring.

16. The venting assembly of claim 10, wherein the housing further comprises one or more stop projections extending downwardly around the outer periphery of the combustion air aperture in substantially abutting contact with a peripheral edge of the gasket, and wherein the upper tubular portion comprises an enlarged diameter portion provided with a contact rim defining an upper air intake bore, wherein the upper air intake bore is larger than the combustion air aperture, and the stop projection is shaped for confining the slidable movement of the contact rim relative to the gasket to reduce or substantially prevent a loss of fluid sealing contact therebetween.

17. The venting assembly of claim 10, wherein the body portion comprises plastic forward and rear shell casings shaped for complementary engagement therebetween to cooperatively form the body portion.

18. A fluid joint assembly for fluidically coupling a first fluid duct and a second fluid duct to a coaxial fluid pipe assembly having a first fluid pipe and a second fluid pipe disposed in the first fluid pipe in a generally coaxial orientation therewith, the fluid joint assembly being configured to fluidically couple the first fluid duct to the first fluid pipe, and the second fluid duct to the second fluid pipe, wherein the first fluid duct is located at a lateral distance from the second fluid duct, and wherein the fluid joint assembly comprises a generally hollow housing, a connecting conduit at least partially disposed in the housing, and an adjustable duct coupling assembly movably coupled to the housing, wherein:

the connecting conduit comprises a first conduit portion and a second conduit portion in fluid communication with the first conduit portion, the second conduit portion being shaped for fluid communication with the second fluid duct;

the housing comprises a body portion defining a first duct coupling aperture, a second duct coupling aperture lateral spaced from the first duct coupling aperture, a coaxial pipe coupling aperture and a generally hollow interior in fluid communication with each said aperture, the second duct coupling aperture being sized to receive the second conduit portion therethrough in an assembled arrangement, whereby the connecting conduit is at least partially disposed in the hollow interior with the first conduit portion positioned proximal to the coaxial pipe coupling aperture; and the coupling assembly comprises a retention member, a resiliently deformable gasket for placement on the body portion around an outer periphery of the first duct coupling aperture, and an axially open tubular member comprising a first tubular portion and a second tubular portion in fluid communication with the first tubular portion, the first tubular portion being shaped for fluid communication with the first fluid duct, wherein in the assembled arrangement, the retention member is for placement in the hollow interior in at least partial abutting contact with an inner periphery of the first duct coupling aperture to movably hold the second tubular portion in seated fluid sealing engagement against bias of the gasket around the outer periphery, thereby fluidically coupling the tubular member and the first duct coupling aperture, and wherein the retention member is sized to permit slidable movement of the second tubular portion relative to the gasket about the first duct coupling aperture to thereby allow the fluid communication between the first tubular portion and the first fluid duct at the lateral distance from the second fluid duct; and wherein the coaxial pipe coupling aperture is sized to fluidically couple to the first fluid pipe, and the first conduit portion is sized to fluidically couple to the second fluid pipe.

19. The joint assembly of claim 18, wherein the body portion comprises a first wall defining the first duct coupling aperture and the second duct coupling aperture, a second wall generally opposed to the first wall, and a sidewall coupled to the first wall and the second wall, the sidewall having opposed first and second sidewall portions, wherein the first sidewall portion defines the coaxial pipe coupling aperture, and the first conduit portion extends substantially normal from the second conduit portion towards the coaxial pipe coupling aperture to define an exhaust bore in substantial coaxial alignment with the coaxial pipe coupling aperture in the assembled arrangement, the exhaust bore being smaller than the coaxial pipe coupling aperture.

20. The joint assembly of claim 19, wherein the second sidewall portion defines a further coaxial pipe coupling aperture opposed to the coaxial pipe coupling aperture, and the housing further comprises an aperture cover sized for fluidically sealing the coaxial pipe coupling aperture or the further coaxial pipe coupling aperture, and wherein in the assembled arrangement, the first conduit portion extends towards one of the coaxial pipe coupling aperture and the further coaxial pipe coupling aperture, and the aperture cover fluidically seals other one of the coaxial pipe coupling aperture and the further coaxial pipe coupling aperture.

21. The joint assembly of claim 20, wherein the first conduit portion further defines a flue gas test port opposed to the exhaust bore, the flue gas test port being selectively movable between an open position and a closed position, wherein in the assembled arrangement, the test port is for positioning in the hollow interior proximal to the coaxial pipe coupling aperture when the first conduit portion extends towards the further coaxial pipe coupling aperture, and the test port is for positioning in the hollow interior proximal to the further coaxial pipe coupling aperture when the first conduit portion extends towards the coaxial pipe coupling aperture.

22. The joint assembly of claim 19, wherein the first and second sidewall portions cooperatively define an inner engagement chamber extending inwardly from the flue gas aperture towards the coaxial pipe coupling aperture or the further coaxial pipe coupling aperture, the inner engagement chamber being shaped for at least partially receiving the second conduit portion in complementary nested engagement therewith.

23. The joint assembly of claim 18, wherein the retention member comprises an outer rim, a first inner engagement hub, and two or more first support spokes each extending inwardly from the outer rim to the first inner engagement hub, the outer rim being larger than the first duct coupling aperture to substantially prevent passage of the retention member therethrough, and wherein the second tubular portion comprises a second inner engagement hub and two or more second support spokes each extending inwardly from an inner surface of the second tubular portion to the second inner engagement hub, wherein one or both of the first and second inner engagement hubs extend through the first duct coupling aperture to removably engage the other said engagement hub.

24. The joint assembly of claim 23, wherein the first inner engagement hub comprises a receiver ring oriented substantially coplanar with the outer rim, and the second inner engagement hub comprises an elongated insertion member sized to be removably received in the receiver ring, wherein in the assembled arrangement, the elongated insertion member extends through the first duct coupling aperture for complementary mated engagement in the receiver ring.

25. The joint assembly of claim 18, wherein the housing further comprises one or more stop flanges located around the outer periphery of the first duct coupling aperture in substantially abutting contact with a peripheral edge of the gasket, and wherein the second tubular portion comprises an enlarged diameter portion provided with a contact rim defining an air intake bore, wherein the air intake bore is larger than the first duct coupling aperture, and the stop flange is shaped for confining the slidable movement of the contact rim relative to the gasket to reduce or substantially prevent a loss of fluid sealing contact therebetween.

26. The joint assembly of claim 18, wherein the body portion comprises first and second plastic shell casings shaped for complementary engagement therebetween to cooperatively form the body portion.

* * * * *